US010019889B2

(12) United States Patent
Stewart

(10) Patent No.: US 10,019,889 B2
(45) Date of Patent: Jul. 10, 2018

(54) ENHANCED DETECTION DEVICES USING CONSUMER COMMUNICATION DEVICES FOR ADDITIONAL NOTIFICATIONS

(71) Applicant: THOMSON LICENSING, Issy de Moulineaux (FR)

(72) Inventor: John Sidney Stewart, Indianapolis, IN (US)

(73) Assignee: THOMSON Licensing, Issy-les-Moulineaux (FR)

( * ) Notice: Subject to any disclaimer, the term of this patent is extended or adjusted under 35 U.S.C. 154(b) by 0 days.

(21) Appl. No.: 14/823,202

(22) Filed: Aug. 11, 2015

(65) Prior Publication Data

US 2016/0049070 A1 Feb. 18, 2016

Related U.S. Application Data

(60) Provisional application No. 62/036,703, filed on Aug. 13, 2014.

(51) Int. Cl.
*G08B 25/10* (2006.01)
*G08B 27/00* (2006.01)

(52) U.S. Cl.
CPC ..... *G08B 27/005* (2013.01)

(58) Field of Classification Search
CPC ..... G08B 25/006; G08B 25/009
USPC ..... 340/538.15, 508, 531, 539.18, 628
See application file for complete search history.

(56) References Cited

U.S. PATENT DOCUMENTS 5,587,705 A 12/1996 Morris
6,121,885 A 9/2000 Masone et al.
6,144,310 A 11/2000 Morris
6,323,780 B1 11/2001 Morris
6,420,973 B2 7/2002 Acevedo
6,522,248 B1 2/2003 Andres et al.
6,710,715 B2 3/2004 Deeds
6,778,082 B2 8/2004 Goodwin
(Continued)

FOREIGN PATENT DOCUMENTS

WO WO2006026025 A2 3/2006

OTHER PUBLICATIONS

Electrical Contractor Magazine.com, "Encoding Fire Systems," 2010, Making Integration Work, Part 4. Retrieved May 6, 2014.

*Primary Examiner* — Kevin Kim
(74) *Attorney, Agent, or Firm* — Brian J. Dorini; Joseph J. Opalach

(57) ABSTRACT

A method and apparatus for operating an enhanced detection device are described including detecting an emergency alert in a protected structure, performing a first determination if the emergency alert is to be forwarded to other enhanced detection devices within the protected structure, forwarding the emergency alert to other enhanced detection devices within the protected structure responsive to the first determination, notifying occupants of the protected structure using capabilities of the enhanced detection device, performing a second determination if the emergency alert is to be forwarded to a consumer communication device and forwarding the emergency alert to the consumer communication device. Also described are a method and apparatus for operating a consumer communication device including receiving an emergency alert and notifying a user of the consumer communication device of a time, location and nature of the emergency alert.

9 Claims, 6 Drawing Sheets

(56) References Cited

U.S. PATENT DOCUMENTS

| | | | | |
|---|---|---|---|---|
| 7,019,646 | B1 | 3/2006 | Woodard et al. | |
| 7,039,387 | B2 | 5/2006 | MacOlly, Jr. et al. | |
| 7,417,540 | B2 | 8/2008 | Johnston et al. | |
| 7,463,986 | B2 | 12/2008 | Hayes | |
| 7,893,825 | B2 | 2/2011 | Gonzales | |
| 8,027,659 | B1 | 9/2011 | Daly et al. | |
| 8,478,225 | B2 | 7/2013 | Sennett et al. | |
| 8,988,232 | B1 | 3/2015 | Sloo et al. | |
| 2001/0041980 | A1 | 11/2001 | Howard et al. | |
| 2003/0069002 | A1 | 4/2003 | Hunter et al. | |
| 2004/0085218 | A1 | 5/2004 | Pecora | |
| 2004/0183687 | A1 | 9/2004 | Petite et al. | |
| 2006/0271314 | A1 | 11/2006 | Hayes | |
| 2007/0109114 | A1 | 5/2007 | Farley et al. | |
| 2007/0194906 | A1* | 8/2007 | Sink | G08B 17/10 340/506 |
| 2007/0207771 | A1 | 9/2007 | Bowser et al. | |
| 2007/0216535 | A1 | 9/2007 | Carrino | |
| 2007/0296575 | A1 | 12/2007 | Eisold et al. | |
| 2008/0055097 | A1 | 3/2008 | Chidakel et al. | |
| 2008/0186135 | A1 | 8/2008 | Boling et al. | |
| 2009/0031340 | A1 | 1/2009 | Modi et al. | |
| 2009/0134982 | A1 | 5/2009 | Robertson et al. | |
| 2009/0170529 | A1 | 7/2009 | Kane | |
| 2009/0247110 | A1 | 10/2009 | Sennett et al. | |
| 2010/0075591 | A1 | 3/2010 | Eyer et al. | |
| 2010/0107192 | A1 | 4/2010 | Sennett et al. | |
| 2011/0128144 | A1 | 6/2011 | Baron, Sr. et al. | |
| 2013/0183924 | A1* | 7/2013 | Saigh | H04W 4/025 455/404.2 |
| 2014/0031082 | A1 | 1/2014 | Zishaan | |
| 2014/0062297 | A1 | 3/2014 | Bora et al. | |
| 2014/0062693 | A1* | 3/2014 | Watts | G08B 27/006 340/539.11 |
| 2014/0313044 | A1 | 10/2014 | Thompson et al. | |
| 2015/0065078 | A1 | 3/2015 | Mejia et al. | |
| 2015/0077737 | A1 | 3/2015 | Belinsky et al. | |
| 2015/0109104 | A1 | 4/2015 | Fadell et al. | |
| 2015/0187194 | A1* | 7/2015 | Hypolite | G08B 7/06 340/628 |
| 2015/0332580 | A1* | 11/2015 | Bokhary | G08B 25/016 340/539.13 |

* cited by examiner

ENHANCED DETECTION DEVICES USING CONSUMER COMMUNICATION DEVICES FOR ADDITIONAL NOTIFICATIONS

RELATED APPLICATIONS

This application claims the benefit under 35 U.S.C. § 119(e) of U.S. Provisional Patent Application No. 62/036,703 filed Aug. 13, 2014.

FIELD OF THE INVENTION

The present invention relates to use of enhanced detection devices that are in communication with consumer communication devices for additional notifications.

BACKGROUND OF THE INVENTION

In multicast and broadcast applications, data are transmitted from a server to multiple receivers over wired and/or wireless networks. A multicast system as used herein is a system in which a server transmits the same data to multiple receivers simultaneously, where the receivers form a subset of all the receivers up to and including all of the receivers. A broadcast system is a system in which a server transmits the same data to all of the receivers simultaneously. That is, a multicast system by definition can include a broadcast system.

This section is intended to introduce the reader to various aspects of art, which may be related to the present embodiments that are described below. This discussion is believed to be helpful in providing the reader with background information to facilitate a better understanding of the various aspects of the present disclosure. Accordingly, it should be understood that these statements are to be read in this light.

Detection devices exist for detecting alert or alarm situations in a residence or small commercial establishment. Such a residence or small commercial establishment is called a protected structure herein. Enhanced detection devices have recently come on the market.

SUMMARY OF THE INVENTION

There are many devices that are coming on the market today that include a wireless local area network technology transceiver. Such a transceiver allows an electronic device to exchange data or connect to the internet. As used herein WiFi is any such wireless local area network technology and not meant to include only those devices that are specifically certified as Wi-Fi. It should also be noted that while Wi-Fi and wireless local area network technology is used to explain the proposed method and apparatus, the proposed method and apparatus is not limited to wireless technologies but may also be used with wired line technologies.

A recently released device is a combination smoke detector and carbon monoxide detector for a residential or small commercial environment. This enhanced detection device has some unique features that are quite advanced over existing detectors. For example, if one has multiple enhanced detectors in a residential or small commercial environment (building), the enhanced detectors can communicate with each other via WiFi and if one such enhanced detection device detects smoke, that enhanced device is able to alert the other enhanced detectors to sound an alarm as well. Herein, smoke and carbon monoxide detectors are used to explain the proposed method and apparatus but the detectors may, in fact, be enhanced detectors adapted to detect other alerts or alarms such as motion detectors, freeze detectors, rain detectors, glass breakage detectors and the like. Such enhanced detection devices may also be able to receive medical or life alerts from people in possession of medical or life alert devices and in the vicinity of such enhanced detection devices.

Such enhanced detection devices include a network adapter in order to communicate with devices using wireless local area network technology to receive emergency notifications. The proposed method and apparatus enhances the alerting of such an enhanced detection device using an Ethernet connected TV or other consumer communication device as an additional alert device.

Many devices can use wireless local area network technology. For example, personal computers, video-game consoles, dual mode smartphones, some digital cameras, tablet computers and digital audio players all use wireless local area network technology. Such devices are called consumer communication devices herein. These devices can connect to a network resource such as the Internet via a wireless network access point. Such an access point can be for example, a cable modem or a satellite modem. If there are multiple devices, then a cable modem or satellite modem may be used in conjunction with a router, bridge or brouter. Devices such as dual mode smartphones may be preconfigured to receive emergency alert or alarm notifications from enhanced detection devices. Many current televisions are also equipped with local area networking technology (using network adapters or the equivalent), both wired and wireless. In addition, many devices maintain some portion of their receiving circuitry active even when the device is "turned off" so that the devices are in a standby mode. This standby mode would give the devices the capability to receive emergency alerts and alarms even when not actively in use. The proposed method and apparatus uses a device, such as a television or other consumer communication device such as described above, in order to communicate with such enhanced detection devices and provide an additional means for alerting occupants of a residence or small commercial building of a detected alert or alarm. Emergency alerts and alarms may also be communicated (forwarded, transmitted, sent) to persons having an interest in the protected structure or the occupants thereof.

A method and apparatus for operating an enhanced detection device are described including detecting an emergency alert in a protected structure, performing a first determination if the emergency alert is to be forwarded to other enhanced detection devices within the protected structure, forwarding the emergency alert to other enhanced detection devices within the protected structure responsive to the first determination, notifying occupants of the protected structure using capabilities of the enhanced detection device, performing a second determination if the emergency alert is to be forwarded to a consumer communication device and forwarding the emergency alert to the consumer communication device. Also described are a method and apparatus for operating a consumer communication device including receiving an emergency alert and notifying a user of the consumer communication device of a time, location and nature of the emergency alert. A method and apparatus for operating a communication device is also described including receiving a notification of an emergency alert from an enhanced detection device and forwarding the notification of the emergency alert to a consumer communication device.

BRIEF DESCRIPTION OF THE DRAWINGS

The present invention is best understood from the following detailed description when read in conjunction with the accompanying drawings. The drawings include the following figures briefly described below.

Figure 1:
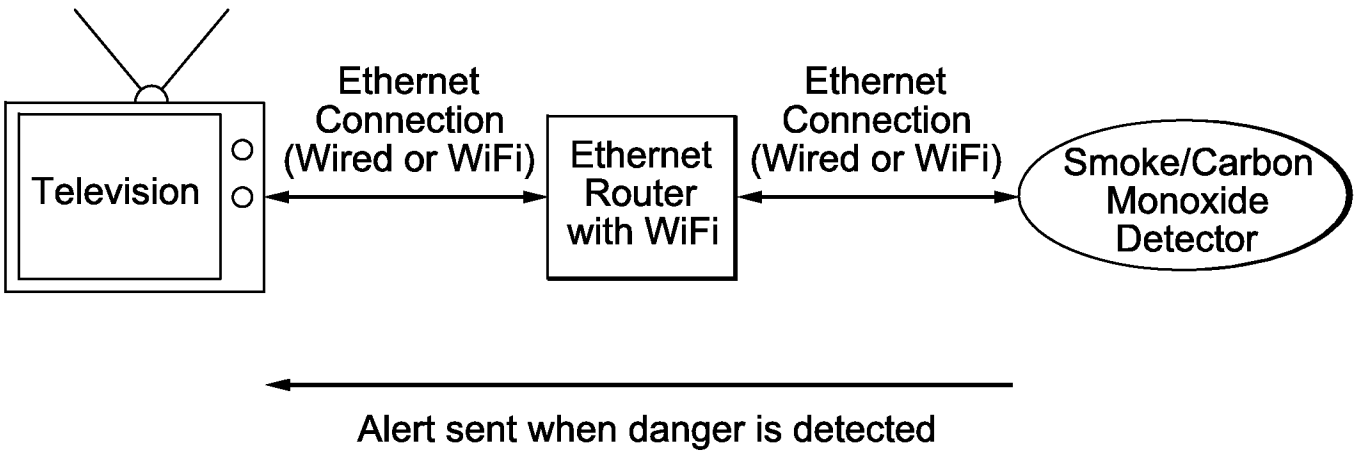
FIG. 1 is a schematic diagram of the proposed system in accordance with the principles described herein.

It should be understood that the drawing(s) are for purposes of illustrating the concepts of the disclosure and is not necessarily the only possible configuration for illustrating the disclosure.

DETAILED DESCRIPTION OF THE PREFERRED EMBODIMENTS

The present description illustrates the principles of the present disclosure. It will thus be appreciated that those skilled in the art will be able to devise various arrangements that, although not explicitly described or shown herein, embody the principles of the disclosure and are included within its scope.

All examples and conditional language recited herein are intended for educational purposes to aid the reader in understanding the principles of the disclosure and the concepts contributed by the inventor to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that the block diagrams presented herein represent conceptual views of illustrative circuitry embodying the principles of the disclosure. Similarly, it will be appreciated that any flow charts, flow diagrams, state transition diagrams, pseudo-code, and the like represent various processes which may be substantially represented in computer readable media and so executed by a computer or processor, whether or not such computer or processor is explicitly shown.

The functions of the various elements shown in the figures may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read only memory (ROM) for storing software, random access memory (RAM), and nonvolatile storage.

Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

In the claims hereof, any element expressed as a means for performing a specified function is intended to encompass any way of performing that function including, for example, a) a combination of circuit elements that performs that function or b) software in any form, including, therefore, firmware, microcode or the like, combined with appropriate circuitry for executing that software to perform the function. The disclosure as defined by such claims resides in the fact that the functionalities provided by the various recited means are combined and brought together in the manner which the claims call for.

The proposed method and apparatus uses the Ethernet connection of future TVs and other consumer communication devices to allow them to be used as an additional alerting device for enhanced detection devices. If an enhanced detection device such as an Ethernet enabled smoke/carbon monoxide detector (DETECTOR) detected a condition (situation) that necessitated setting off its alarm, the enhanced detection device could also send messages over the ETHERNET connection to TVs (e.g., ATSC 3.0 compatible) or other consumer communication devices within the home. The consumer communication devices could be used to alert residents in a number of ways:

1) Play a tone or beep loudly using the audio system.
2) Flash a bright then dark pattern as an alert (especially useful for hearing impaired residents).
3) Play an audio recording such as "Smoke detected. Leave Immediately"
4) Display a text message or pre-recorded video indicated the alert.
5) Some combination of the above.

These alerts would interrupt a program currently being viewed (watched) on a consumer communication device or audio played on other consumer communication devices. For more safety, the consumer communication device could have a mode where in the "OFF" state, the consumer communication device would still keep the Ethernet interface alive (e.g., a standby mode) to monitor for the alerts from the DETECTORs.

The enhanced detection devices also include access to a web site and mobile phone application (APP) that gives users access to the status of the DETECTORs whether one is presently at the residence or small commercial building (protected structure) or away. This would give users the capability to be notified if an alert or alarm had been detected at the protected structure but the user is away at the time. Users may wish to be notified if an alert or alarm occurs at several protected structures such as a primary residence, a vacation home, their small business and/or the residence of an elderly relative. The enhanced detection device software also knows the address of the protected structures (environments, buildings) since the address is input as part of the software setup. Knowing the address of the protected structure will allow the DETECTORs to notify a user of a consumer communication device via the consumer communication device if an alert or alarm pertains to any of the protected structures of interest. Emergency alerts or alarms may, in fact, be notifications of medical or life alerts for an elderly relative. The emergency alert or alarm may have been received by an enhanced detection device when the person having the medical or life emergency alert or alarm is in the vicinity of the enhanced detection device. Any such medical or life alert notification is secondary to notification directly to a 911 center by the medical or life alert monitoring company.

FIG. 1 is a schematic diagram of the proposed system in accordance with the principles described herein. FIG. 1 shows an enhanced detection device (such as a smoke or carbon monoxide detector). The enhanced detection device is in communication wirelessly with other such enhanced detection devices in the same protected structure so that any or all of the enhanced detection devices can sound an alarm based on the detected condition. The proposed system extends the use of the enhanced detection devices by using a router (such as an Ethernet router, a bridge or a brouter). Routers and like devices are called communication devices herein. Each enhanced detection device has a network adapter in order to communicate with each other as well as to communication with any communication device. The router (router, bridge or brouter) is in communication with a consumer communication device such as an ATSC 3.0 television or any other consumer communication devices, such as personal computers, laptop computers, notebook computers, dual mode smartphones, tablet computers and the like. If an emergency alert or alarm condition is detected by any enhanced detection device in the protected structure then the enhanced detection device forwards (communicates, transmits, sends) the alert or alarm to the communication device, which is turn forwards (communicates, transmits, sends) the alert or alarm to the consumer communication device. A TV is shown in FIG. 1 but the TV may be replaced with any other device configured as a consumer communication device with Internet access. Communication devices are also equipped with network adapters in order to communicate with the enhanced detection devices as well as consumer communication devices, which are also equipped with network adapters for the same reason.

Among the enhanced detection devices there may be a master enhanced detection device which communicates the emergency alerts or alarms to any slaved enhanced detection devices or all of the enhanced detection devices may receive the alerts or alarms notifications simultaneously. If there is a master enhanced detection device, such a master detection device may make a decision as to whether to sound an alarm or forward the emergency alert or alarm to one or more consumer communication devices (via a communication device) to notify the users present in the protected structure or to notify users who have an interest in the protected structure. The master enhanced detection device forwards the emergency alert or alarm as well as the means by which any slaved enhanced detection devices are to communicate the emergency alert system notification to anyone present in the protected structure. The emergency alert or alarm may be communicated to users present in the protected structure or to consumer communication devices within the protected structure or to consumer communication devices of users who have an interest in the protected structure.

Figure 2:
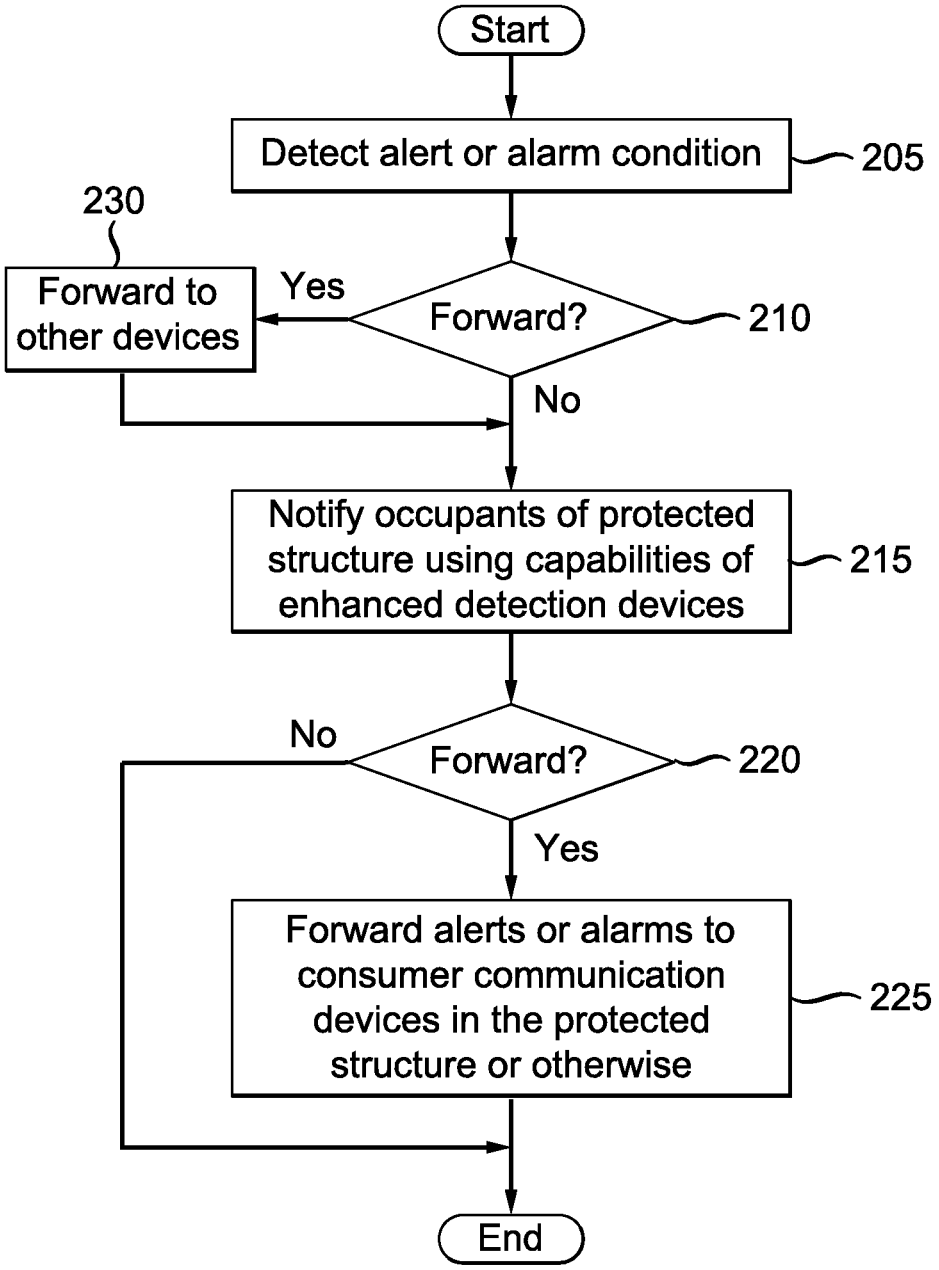
FIG. 2 is a flowchart of the operation of an enhanced detection device in accordance with the principles described herein.

FIG. 2 is a flowchart of the operation of an enhanced detection device in accordance with the principles described herein. At 205 the enhanced detection device detects an emergency alert or alarm condition. At 210 a determination is made whether the detected emergency alert or alarm is to be forwarded to other enhanced detection devices within the protected structure. If the detected emergency alert or alarm is to be forwarded to other enhanced detection devices within the protected structure then the detected emergency alert or alarm is forwarded at 230. At 215 the enhanced detection device notifies occupants of the protected structure using the capabilities of the enhanced detection devices. This is accomplished using sounds or tones or flashing lights or a voice capability of the enhanced detection device(s). If the alert or alarm is not to be forwarded then processing proceeds to 215 without forwarding the alert or alarm to any other enhanced detection devices within the protected structure. At 220 a determination is made whether the detected emergency alert or alarm is to be forwarded to consumer communication devices within the protected structure or elsewhere or both within the protected structure and elsewhere. Elsewhere is used here to handle the situation where the users having an interest in the protected structure are away from the protected structure or the protected structure is the location of the user's small business or the protected structure is a vacation home or the protected structure is the residence of an elderly relative. If the detected emergency alert or alarm is to be forwarded to consumer communication devices within the protected structure or elsewhere or both within the protected structure and elsewhere then at 225 the enhanced detection device forwards the alert or alarm to consumer communication devices within the within the protected structure or elsewhere or both within the protected structure and elsewhere.

Figure 3:
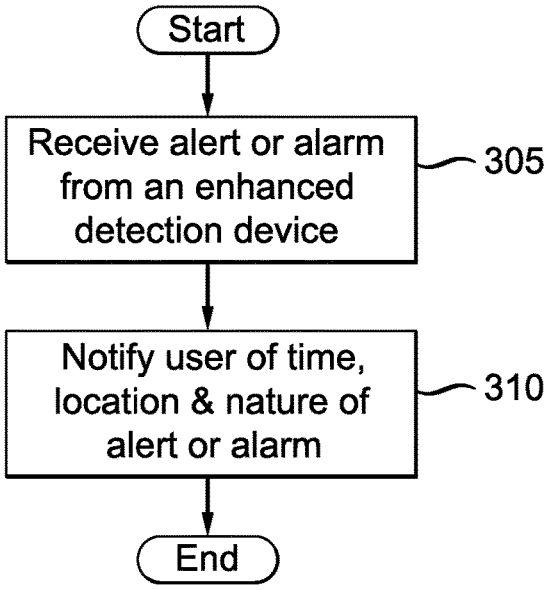
FIG. 3 is a flowchart of the operation of a consumer communication device in accordance with the principles described herein.

FIG. 3 is a flowchart of the operation of a consumer communication device in accordance with the principles described herein. At 305 the consumer communication device receives an emergency alert or alarm from an enhanced detection device via a communication device. The alert may be from within the protected structure or from a protected structure of interest to the user of the consumer communication device, such as a business location, a vacation home or the residence of an elderly relative. At 310 the consumer communication device notifies the user of the time, location and nature of the alert or alarm. The notification may be in the form of a sound, a tone, flashing lights, a text message or a voice capability. If the emergency alert or alarm is communicated by sounds, tones or flashing lights then only the fact that there is emergency alert or alarm can be communicated and no information about the time, location and nature of the alarm can be communicated. Such time, location and nature information can only be communicated if the emergency alert or alarm is communicated using text messages or the voice capability.

Figure 4:
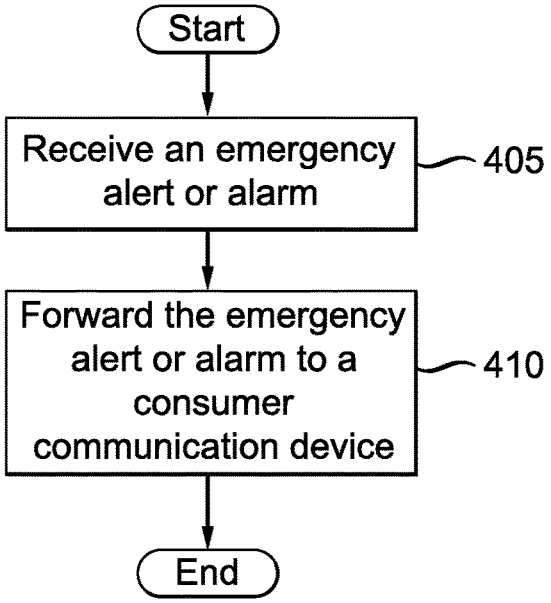
FIG. 4 is a flowchart of the operation of a communication device in accordance with the principles described herein.

FIG. 4 is a flowchart of the operation of a communication device in accordance with the principles described herein. At 405 the communication device receives a notification of an emergency alert or alarm from an enhanced detection device. At 410 the communication device communicates (forwards, sends, transmits) the notification the emergency alert or alarm notification to a consumer communication device within the protected structure or elsewhere or to both consumer communication devices within the protected structure and elsewhere.

The consumer communication device depicted in FIG. 1 includes a network adapter for receiving emergency alert or alarm notifications from enhanced detection devices via a communication device. The consumer communication device also includes a processor for determining how the user of the consumer communication device should be notified (sounds, tones, flashing lights, text messages, voice).

The communication device of FIG. 1 includes a network adapter for communicating with consumer communication devices and enhanced detection devices. The communication device also has a processor. The communication device has the means for receiving an emergency alert or alarm notification from an enhanced detection device and (the means to) forward (transmit, send, communicate) emergency alert or alarm notifications to one or more consumer communication devices. The emergency alert or alarm notification is received via the network adapter and is forwarded to one or more consumer communication devices via network adapters in the communication device.

The enhanced detection device of FIG. 1 includes a network adapter for communicating with a communication device. The enhanced detection device detects an emergency alert or alarm and notifies other (e.g., slaved) enhanced detection devices and/or consumer communication devices via network adapters in the devices (communication devices and consumer communication devices). The enhanced detection device also includes a processor which, upon receipt of the emergency notification makes a determination regarding the best means by which to alert anyone present in the protected structure. This determination may be based at least in part on whether the enhanced detection was set-up to use flashing lights in addition to or as an alternative to an audible alarm. This may be the case if there are any hearing impaired persons usually in the protected structure. If the determination is made to use an audible alarm or flashing lights then the enhanced detection device initiates the alarm and/or flashing lights. This is accomplished with any circuit well known in the art. If the determination is made not to use an audible alarm or flashing lights then the enhanced detection device initiates communication of the emergency alert or alarm verbally using a voice (or speech) synthesizer or the equivalent, which is also included in the enhanced detection device. Emergency alerts or alarms may also be communicated by text messages. Using the network adapter, the enhanced detection device is able to forward the emergency alerts or alarms to other enhanced detection devices in the protected structure. Using the network adapter the enhanced detection device is also able to forward instructions as to the best means by which the emergency alert or alarm notification is to be communicated by the other enhanced detection devices.

Figure 5:
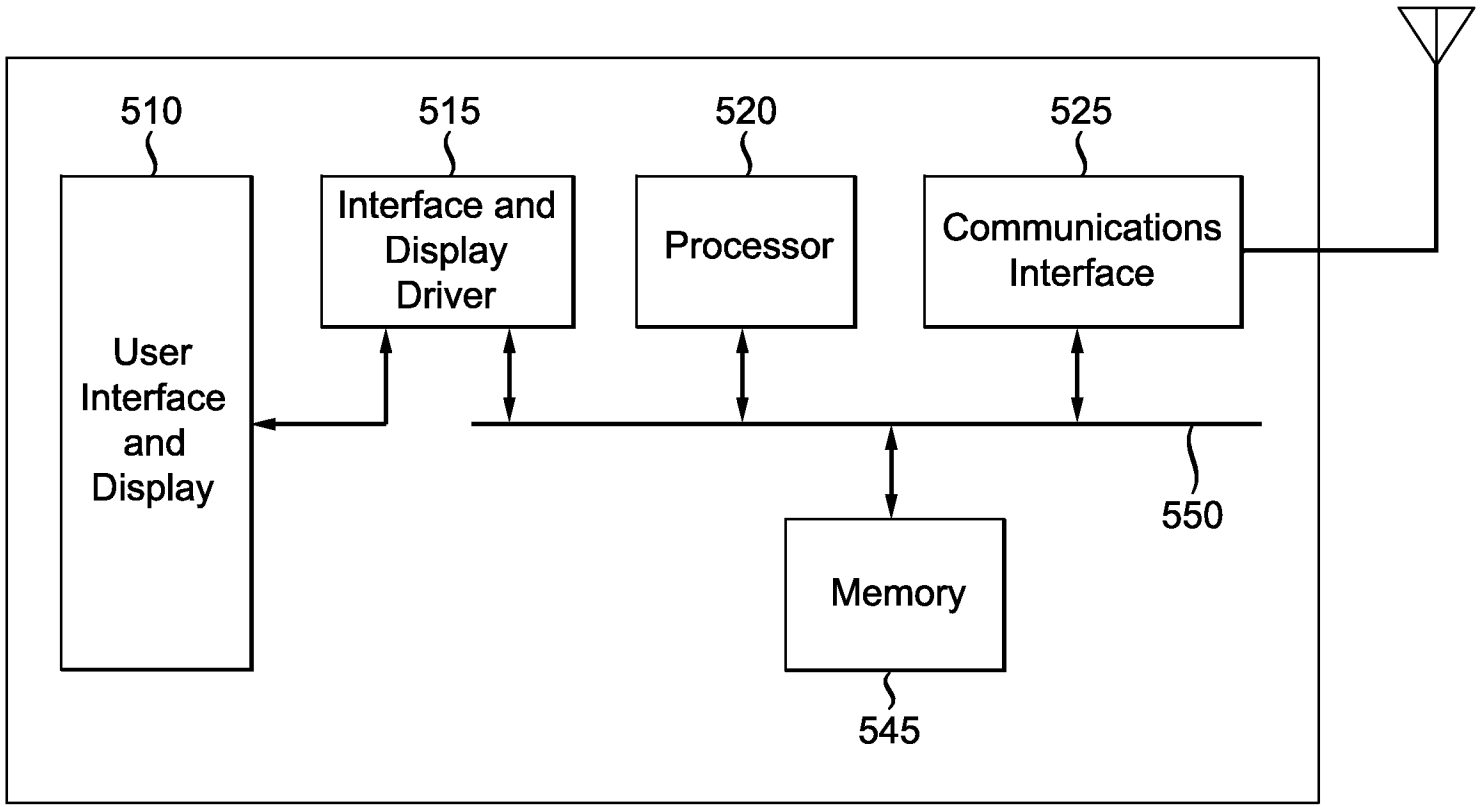
FIG. 5 is an exemplary block diagram of a consumer communication device in accordance with the principles described herein.
Figure 7:
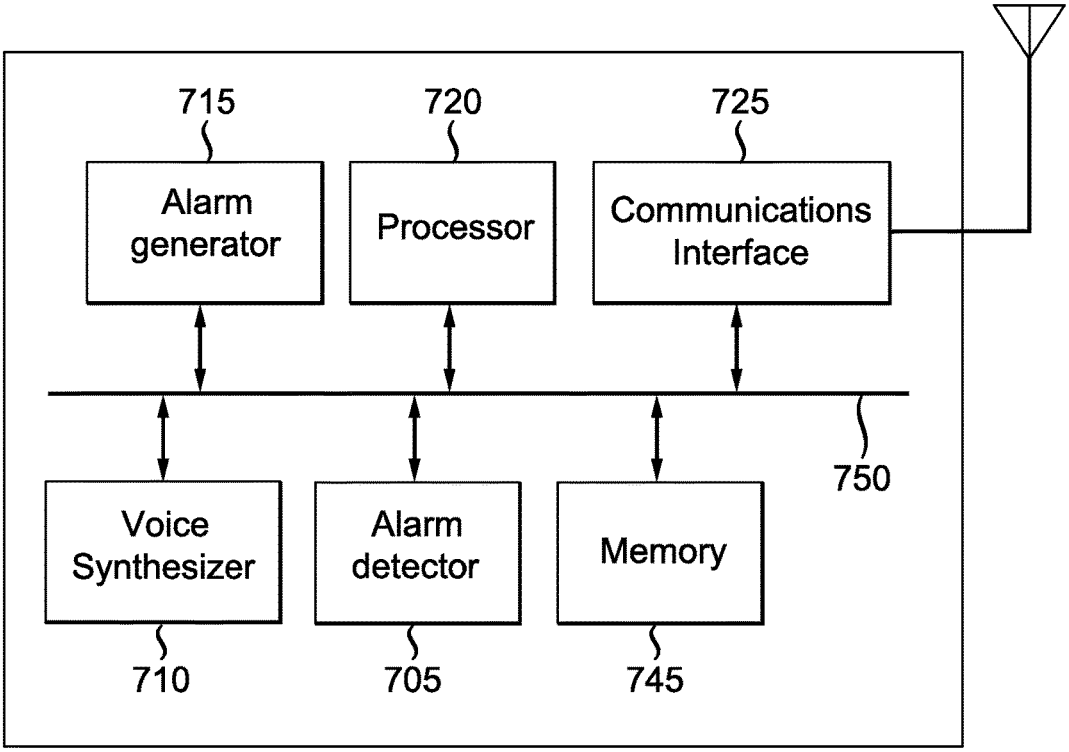
FIG. 7 is an exemplary block diagram of an enhanced detection device in accordance with the principles described herein.

FIG. 5 is an exemplary block diagram of a consumer communication device in accordance with the principles described herein. The block diagram configuration includes a bus-oriented 550 configuration interconnecting a processor 520, and a memory 545. The configuration of FIG. 5 also includes a communications interface 655 to enable communications with a communication device such as a router, bridge or brouter or any other sort of gateway device such as shown in FIG. 7 and described below and throughout the text above. The consumer communication device may utilize either a wired or a wireless interface to the communication device.

Processor 520 provides computation functions for the consumer communication device. The processor 520 can be any form of CPU or controller that utilizes communications between elements of the consumer communication device to control communication and computation processes. Those of skill in the art recognize that bus 550 provides a communication path between the various elements of the exemplary embodiment and that other point-to-point interconnection options (e.g. non-bus architecture) are also feasible. The processor determines determining if the received content is an emergency alert system notification.

Memory 545 can act as a repository for memory related to any of the methods that incorporate the functionality of the consumer communication device. Memory 545 can provide the repository for storage of information such as program memory, downloads, uploads, or scratchpad calculations as well as the storage of streamed or downloaded content. Those of skill in the art will recognize that memory 545 may be incorporated all or in part of processor 520. Communications interface 525 has both receiver and transmitter elements for communication as known to those of skill in the art. Communications interface 525 also includes a network adaptor (not shown) for enabling communications with the communication device. Communications interface is the means by which broadcast content is received as well. The communications interface receives content from a service provider via the network adaptor. The communications interface receives the emergency alert system notification from the communication device, using the network adapter.

User interface and display 510 is driven by interface and display driver circuitry 515. The user interface and display 510 is used as a multimedia interface having both audio and video capability to display streamed or downloaded audio and/or video obtained via communications interface 525.

Figure 6:
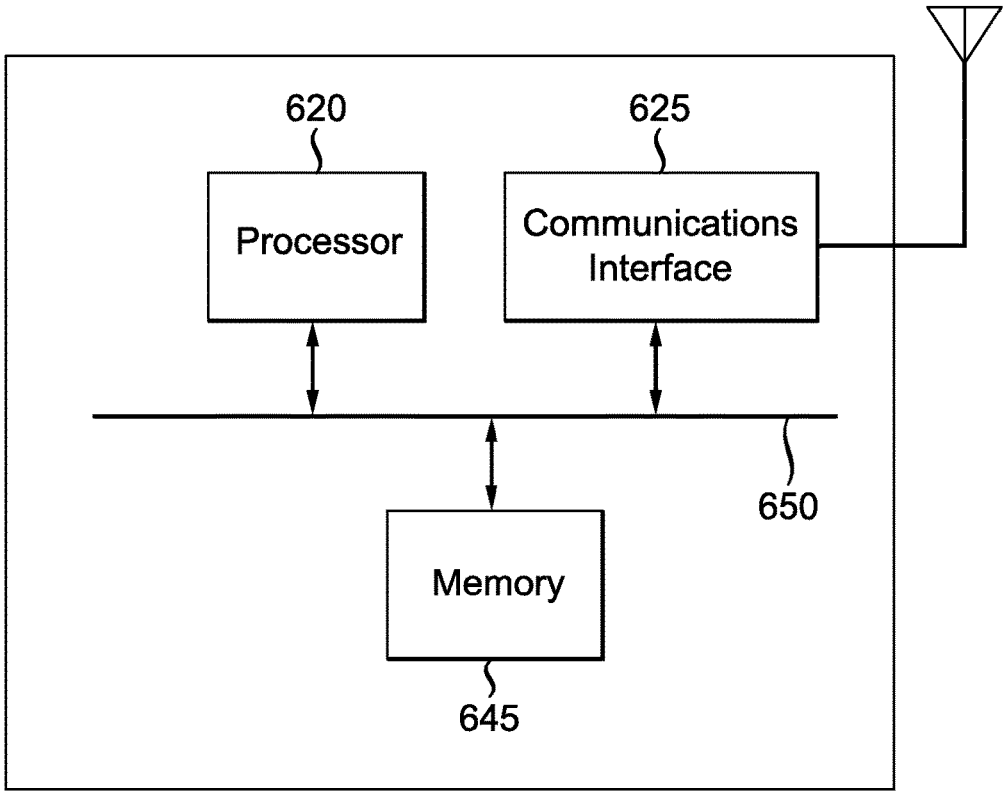
FIG. 6 is an exemplary block diagram of a communication device in accordance with the principles described herein.

FIG. 6 is an exemplary block diagram of a communication device in accordance with the principles described herein. The block diagram configuration includes a bus-oriented 650 configuration interconnecting a processor 620, and a memory 645. The configuration of FIG. 6 also includes a communications interface 625 to enable communications with a consumer communication device such as described above and shown in FIG. 5 and an enhanced detection device such as described above and below with reference to FIG. 7. The communication device may utilize either a wired or a wireless interface to the consumer communication device and the enhanced detection device and the Internet server with EAS information (shown in FIG. 1).

Processor 620 provides computation functions for the communication device. The processor 620 can be any form of CPU or controller that utilizes communications between elements of the communication device to control communication and computation processes. Those of skill in the art recognize that bus 650 provides a communication path between the various elements of the exemplary embodiment and that other point-to-point interconnection options (e.g. non-bus architecture) are also feasible.

Memory 645 can act as a repository for memory related to any of the methods that incorporate the functionality of the communication device. Memory 645 can provide the repository for storage of information such as program memory, downloads, uploads, or scratchpad calculations as well as the storage of streamed or downloaded content. Those of skill in the art will recognize that memory 645 may be incorporated all or in part of processor 620. Communications interface 625 has both receiver and transmitter elements for communication as known to those of skill in the art. Communications interface 625 also includes a network adaptor (not shown) for enabling communications with the consumer communication device and the enhanced detection device.

FIG. 7 is an exemplary block diagram of an enhanced detection device in accordance with the principles described herein. The block diagram configuration includes a bus-oriented 750 configuration interconnecting a processor 720, and a memory 745. The configuration of FIG. 7 also includes a communications interface 725 to enable communications with a communication device such as described above and shown in FIG. 6 and other enhanced detection devices. The enhanced detection device may utilize either a wired or a wireless interface to the communication device.

Processor 720 provides computation functions for the enhanced detection device. The processor 720 can be any form of CPU or controller that utilizes communications between elements of the enhanced detection device to control communication and computation processes. Those of skill in the art recognize that bus 750 provides a communication path between the various elements of the exemplary embodiment and that other point-to-point interconnection options (e.g. non-bus architecture) are also feasible.

Memory 745 can act as a repository for memory related to any of the methods that incorporate the functionality of the enhanced detection device. Memory 845 can provide the repository for storage of information such as program memory, downloads, uploads, or scratchpad calculations as well as the storage of EAS alarms and alarm history. Those of skill in the art will recognize that memory 745 may be incorporated all or in part of processor 720. Communications interface 725 has both receiver and transmitter elements for communication as known to those of skill in the art. Communications interface 725 also includes a network adaptor (not shown) for enabling communications with the communication device.

The enhanced detection device includes an alarm detector 705 for detecting emergency alarms including but not limited to smoke, carbon monoxide, motion detectors, freeze detectors, rain detectors, glass breakage detectors and the like. Such enhanced detection devices may also be able to receive medical or life alerts from people in possession of medical or life alert devices and in the vicinity of such enhanced detection devices.

The enhanced detection device also includes an alarm generator 715, which is used to sound tones or horns or make other such noises or flashing lights as directed by the processor 720 in order to alert persons present in the protected structure. Processor makes a determination which means to use to alert persons present in the protected structure based on preferences set by a user during set-up of the enhanced detection device. The enhanced detection device optionally has a voice synthesizer for communicating an alert or alarm to person present in the protected structure based on user preferences set during set-up of the enhanced detection device.

It is to be understood that the present invention may be implemented in various forms of hardware, software, firmware, special purpose processors, or a combination thereof. Special purpose processors may include application specific integrated circuits (ASICs), reduced instruction set computers (RISCs) and/or field programmable gate arrays (FPGAs). Preferably, the present invention is implemented as a combination of hardware and software. Moreover, the software is preferably implemented as an application program tangibly embodied on a program storage device. The application program may be uploaded to, and executed by, a machine comprising any suitable architecture. Preferably, the machine is implemented on a computer platform having hardware such as one or more central processing units (CPU), a random access memory (RAM), and input/output (I/O) interface(s). The computer platform also includes an operating system and microinstruction code. The various processes and functions described herein may either be part of the microinstruction code or part of the application program (or a combination thereof), which is executed via the operating system. In addition, various other peripheral devices may be connected to the computer platform such as an additional data storage device and a printing device.

It should be understood that the elements shown in the figures may be implemented in various forms of hardware, software or combinations thereof. Preferably, these elements are implemented in a combination of hardware and software on one or more appropriately programmed general-purpose devices, which may include a processor, memory and input/output interfaces. Herein, the phrase "coupled" is defined to mean directly connected to or indirectly connected with through one or more intermediate components. Such intermediate components may include both hardware and software based components.

It is to be further understood that, because some of the constituent system components and method steps depicted in the accompanying figures are preferably implemented in software, the actual connections between the system components (or the process steps) may differ depending upon the manner in which the present invention is programmed. Given the teachings herein, one of ordinary skill in the related art will be able to contemplate these and similar implementations or configurations of the present invention.

The invention claimed is:

1. An enhanced detection device, comprising:

an alarm detector of said enhanced detection device, detecting an emergency alert in a protected structure;

a processor for determining if said emergency alert is to be forwarded to other enhanced detection devices within said protected structure, said processor in bi-directional communication with said alarm detector;

a network adapter for forwarding said emergency alert to other enhanced detection devices within said protected structure responsive to said first determination, said network adaptor in bi-directional communications with said processor and said alarm detector;

an alarm generator for notifying occupants of said protected structure using capabilities of said enhanced detection device, said alarm generator in bi-directional communications with said processor;

said processor determining if said emergency alert is to be forwarded to a consumer communication device; and said network adapter also forwarding said emergency alert to said consumer communication device.

2. The enhanced detection device according to claim 1, wherein said consumer communication device is within said protected structure or elsewhere.

3. The enhanced detection device of claim 1, further comprising a voice synthesizer for notifying occupants of said protected structure using capabilities of said enhanced detection device.

4. A method comprising:

detecting, by an alarm detector of an enhanced detection device, an emergency alert in a protected structure;

performing, by a processor of the enhanced detection device, a first determination if said emergency alert is to be forwarded to other enhanced detection devices within said protected structure, said processor in bi-directional communication with said alarm detector;

forwarding, by a network adapter of the enhanced detection device, said emergency alert to other enhanced detection devices within said protected structure responsive to said first determination, said network adaptor in bi-directional communications with said processor and said alarm detector;

notifying, by an alarm generator of the enhanced detection device, occupants of said protected structure using capabilities of said enhanced detection device, said alarm generator in bi-directional communications with said processor;

performing, by the processor of the enhanced detection device, a second determination if said emergency alert is to be forwarded to a consumer communication device; and forwarding, by the network adapter of the enhanced detection device, said emergency alert to said consumer communication device.

5. The method according to claim 4, wherein said consumer communication device is within said protected structure or elsewhere.

6. The method according to claim 4, further comprising:

notifying, by a voice synthesizer of the enhanced detection device, occupants of said protected structure using capabilities of said enhanced detection device.

7. An apparatus, comprising:

an alarm detector of said apparatus, detecting an alert in a protected structure;

a processor for determining if said alert is to be forwarded to one or more apparatuses within said protected structure, said processor in bi-directional communication with said alarm detector;

a network adapter for forwarding said alert to other apparatuses within said protected structure responsive to said first determination, said network adaptor in bi-directional communications with said processor and said alarm detector;

an alarm generator for notifying occupants of said protected structure using capabilities of apparatus, said alarm generator in bi-directional communications with said processor;

said processor determining if said alert is to be forwarded to a consumer communication device; and said network adapter also forwarding said alert to said consumer communication device.

8. The apparatus according to claim 1, wherein said consumer communication device is within said protected structure or elsewhere.

9. The apparatus of claim 1, further comprising a voice synthesizer for notifying occupants of said protected structure using capabilities of said apparatus.

* * * * *